United States Patent [19]

Ikeda et al.

[11] Patent Number: 4,942,817

[45] Date of Patent: Jul. 24, 1990

[54] EXPLOSIVE CARTRIDGE AND PAPER POLYETHYLENE LAMINATED ON BOTH THE SIDES USED THEREFOR

[75] Inventors: Yoshiyuki Ikeda, Ube; Toshinori Ariki, Yamaguchi, both of Japan

[73] Assignee: Nippon Kayaku Kabushiki Kaisha, Tokyo, Japan

[21] Appl. No.: 447,367

[22] Filed: Dec. 7, 1989

[30] Foreign Application Priority Data

Dec. 15, 1988 [JP] Japan ..... 63-161904

[51] Int. Cl.[5] ..... F42G 3/00

[52] U.S. Cl. ..... 102/331; 102/431; 102/433; 102/466; 149/2; 428/537.5

[58] Field of Search ..... 102/331, 431, 433, 466; 149/2; 428/537.5

[56] References Cited

U.S. PATENT DOCUMENTS

| | | | |
|---|---|---|---|
| 4,033,264 | 7/1977 | Bolza et al. | 102/314 |
| 4,052,939 | 10/1977 | Simmons et al. | 102/323 |
| 4,218,272 | 8/1980 | Brockington | 149/2 |
| 4,656,948 | 4/1987 | Tsukiuda et al. | 102/452 |

*Primary Examiner*—Stephen J. Lechert, Jr.
*Attorney, Agent, or Firm*—Henry C. Nields

[57] ABSTRACT

An explosive cartridge produced by packaging an explosive with a paper polyethylene-laminated on both the sides, the outer surface of the cartridge having an angle of slide of not more than 12 degrees and a paper polyethylene-laminated on both the sides, at least one of the outer surfaces of the paper polyethylene-laminated on both the sides having an angle of slide of not more than 12 degrees used in the explosive cartridge are disclosed.

The explosive cartridge of the present invention can be easily loaded into a dry or watery borehole and give good blasting performance.

9 Claims, 1 Drawing Sheet

EXPLOSIVE CARTRIDGE AND PAPER POLYETHYLENE LAMINATED ON BOTH THE SIDES USED THEREFOR

BACKGROUND OF THE INVENTION

The present invention relates to an explosive cartridge used in blasting operations for boring of tunnels, construction of roads, minings, quarryings, etc., and a paper polyethylene-laminated in both the sides thereof used for the explosive cartridge.

The explosives used for blasting are usually offered as cartridges. In a case of dynamite or powdery explosives, for instance, a fixed amount of explosive is packaged with paper to form a cartridge. In the case of water-bearing explosives, the explosive is packaged with a single- or double-ply tubular sheet made of a plastic such as polyethylene, nylon or polypropylene, and the packed tubular sheet is closed at both ends with metal clips (this type of cartridge being hereinafter referred to as "polyfilm cartridge"), or the explosive is packaged with paper or polyethylene-laminated paper, i.e., paper having its one side or both sides laminated with polyethylene.

However, polyfilm cartridge is recently not preferred by users since the explosive cartridges are prone to over-ride or to have foreign substances between them when they are loaded in a borehole, because of their convex ends. Accordingly, even water-bearing explosives are frequently packaged using paper or polyethylene-laminated paper, recently.

In some cases, a seepage of water or gathering of water inside a borehole (hereinafter, such borehole is referred to as "watery borehole") may happen and the water can permeate into an explosive cartridge using paper alone and can results in poor blasting performance, even in partial misfiring. In order to prevent these phenomena, paper coated with a water-proof substance, such as wax, is used to package explosives but the results are usually unsatisfactory.

Therefore, polyethylene-laminated paper has come to be used popularly for packaging dynamite, powdery explosive and water-bearing explosive. Especially a paper polyethylene-laminated on both the sides, namely paper laminated with polyethylene (hereinafter referred to as "PE") layer on both sides is preferably used since an explosive cartridge using paper PE-laminated on both the sides is best suited to load in a watery borehole.

The explosive cartridge using paper PE-laminated on both the sides has not only an advantage that it prevents water from permeating into the cartridge but also an advantage that when the explosive cartridge once loaded in a watery borehole is to be taken out for some reason and again loaded into another borehole, said cartridge is not deformed and present no problem to handle.

However, PE film has very smooth surface in comparison with ordinary paper or wax-coated paper, so that when an explosive cartridge using paper PE-laminated on both the sides is loaded into a borehole having no water, it tends to adhere closely to the flat wall of the borehole and is hard to slide, making the borehole loading operation troublesome and time-consuming. This problem is particularly remarkable when the boreholes run horizontally as in the case of tunnel boring. When the explosive cartridges are hard to slide, that is, hard to load in a borehole, a worker may often fail to effect pertinent loading of explosive cartridges by adequately pushing them into the borehole and tends to make incomplete loading only, giving rise to a possibility of forming air gaps between the cartridges, which often becomes one of causes of partial misfiring or poor blasting performance. At the site of blasting, there usually are watery boreholes and dry boreholes. It is quite unreasonable to make proper use of explosive cartridges according to whether the borehole is watery or dry. It is desirable that the explosive cartridges using water-resistant paper PE-laminated on both the sides can be applied to both types of borehole. The greatest problem in realizing this advantage, therefore, was how to make the explosive cartridge using paper PE-laminated on both the sides easy to slide, that is, easy to be loaded in a borehole no matter whether it is watery or dry.

As a result of extensive studies of the present inventors to solve the problems on the subject matter, it has been found that when an explosive cartridge is prepared using a paper PE-laminated on both the sides, in which at least one of the outer surfaces thereof has been subjected to a specific treatment so that the treated surface has an angle of slide of not more than 12 degrees, such an explosive cartridge can be loaded smoothly, with little resistance, into boreholes having no moisture nor water.

Figure 1:
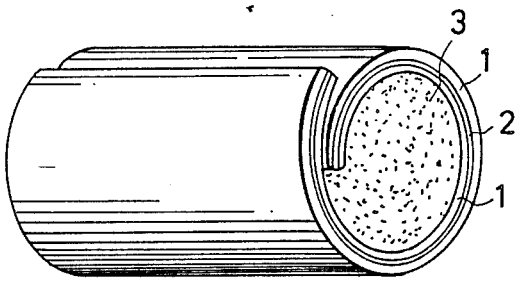
FIGS. 1 and 2 are partial sectional views showing examples of explosive cartridge according to the present invention.
Figure 2:
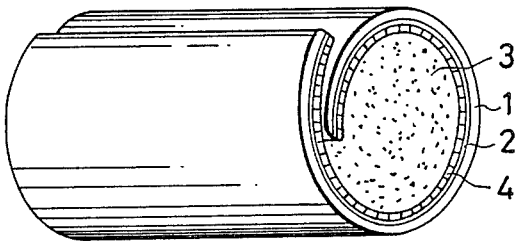

Numeral numbers, Roman letters and Greek letter in the drawings represent the followings:

1: PE laminate ply having an angle of slide of not more than 12 degrees;
2: paper;
3. explosive;
4. ordinary PE laminate ply
A: flat plate;
B: test sample of paper PE-laminated on both the sides;
C: weight made of stainless steel; and
$\theta$. angle of slide.

SUMMARY OF THE INVENTION

In a first aspect of the present invention, there is provided an explosive cartridge produced by packaging an explosive with a paper polyethylene-laminated on both the sides, the outer surface of the cartridge having an angle of slide of not more than 12 degrees.

In a second aspect of the present invention, there is provided a paper polyethylene-laminated on both the sides, at least one of the outer surfaces of the paper polyethylene-laminated on both the sides having an angle of slide of not more than 12 degrees.

DETAILED DESCRIPTION OF THE INVENTION

The present invention relates to an explosive cartridge produced by packaging an explosive with a paper polyethylene-laminated on both the sides, the outer surface of the cartridge having an angle of slide of not more than 12 degrees. The present invention also relates to a paper PE-laminated on both the sides for use in an explosive cartridge produced by packaging an explosive with a paper polyethylene-laminated on both the sides, the outer surface of the cartridge having an angle of slide of not more than 12 degrees. As described in Example 1 shown later, the paper PE-laminated on both the sides of the present invention is especially excellent because there is no adhesion between papers during production of the explosive cartridges and also such explosive cartridge obtained by using the paper PE-laminated on both the sides can be loaded smoothly into a borehole.

The cartridge according to the present invention can be used to pack dynamite and water-bearing explosives, such as water-in-oil type emulsion explosives, slurry explosives, etc.

As a paper of the paper PE-laminated on both the sides according to the present invention, certain natural papers, e.g., manila and kraft papers, cellophane paper, etc. are suitable. Among these papers, craft papers are preferably used in the present invention. The areal weight of the paper for the paper PE-laminated on both the sides of the present invention is 30 to 200 g/m$^2$, preferably 50 to 100 g/m$^2$.

As PE in paper PE-laminated on both the sides applied to the explosive cartridge of the present invention, any of low-density PE, medium-density PE and high-density PE can be used but high-density PE is especially preferable. The thickness of each of the PE laminate plies can be 5 to 200 $\mu$m, preferably 10 to 50 $\mu$m. The PE laminate plies on both sides of the paper can be same or different in their thickness.

In the paper PE-laminated on both the sides used in the explosive cartridge according to the present invention, at least the surface thereof forming the outer surface of the cartridge is treated so that the surface has an angle of slide of not more than 12 degrees, preferably 11 to 8 degrees. Any suitable method can be used for the treatment as far as it is capable of providing an angle of slide of not more than 12 degrees to at least one of the outer surfaces of the paper PE-laminated on both the sides, but it is preferred to employ a satin finish treatment using cooling rolls which are used in laminating PE on a paper. Although it is enough to satinize only one surface of the paper PE-laminated on both the sides which forms the outer surface of the cartridges, of course, no problem exists if on both sides of the paper PE-laminated on both the sides are satinized.

Figure 3:
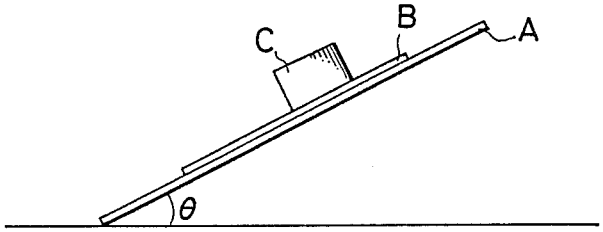
FIG. 3 is a schematic drawing illustrating the method for measuring the angle of slide.

The angle of slide referred to in the present invention is defined as follows. As shown in FIG. 3, a paper PE-laminated on both the sides B to be measured is bonded on a flat plate A with the side to be measured of the paper B placed upside, then a 1 kg stainless steel weight C (65×98×20 mm) is placed thereon (contact area: 6,370 mm$^2$) and the flat plate A is gradually tilted upward until the weight begins to slide down. The angle between the flat plate and the horizontal plane at the time the weight starts to slide is defined as the angle of slide ($\theta$).

The paper PE-laminated on both the sides of the present invention may be made in a tubular form, but usually, in a sheet form in the production process thereof.

The present invention will be explained more in detail referring to the following non-limitative Examples.

The explosive cartridges made by using conventional paper PE-laminated on both the sides had an advantage that they could be used even in watery boreholes without any serious trouble, but they had the defect that difficulties were involved in loading them into dry boreholes. The explosive cartridges using the paper PE-laminated on both the sides according to the present invention, as evident from a comparison of the Examples and the Comparative Example shown below, can be loaded into dry boreholes smoothly, with far smaller resistance than experienced in loading the conventional explosive cartridges, while the advantage in loading into water boreholes is left unchanged. Thus, the explosive cartridges provided by using the described techniques of the present invention have the advantageous characteristics not possessed by the conventional explosive cartridges.

EXAMPLE 1

Dynamite was packaged using a paper PE-laminated on both the sides having a structure shown in the following table to obtain a dynamite cartridge of 25 mm in diameter and 100 g in weight.

| Layer | Material | Thickness or Areal weight | Treating method | Angle of slide (degree) |
|---|---|---|---|---|
| Outer surface | High-density PE | 20 $\mu$m | Satin finish | 11 |
| Core layer | Kraft paper | 70 g/m$^2$ | — | — |
| Inner surface | High-density PE | 20 $\mu$m | Satin finish | 11 |

The dynamite cartridge was subjected to a loading test in which the cartridge was loaded horizontally into an iron tube having an inner diameter of 40 mm and a length of 200 cm. The loading test was performed by pushing the dynamite cartridge toward the opposite end of the iron tube with a wooden pole having 20 mm diameter and 250 cm length. The cartridge was able to be pushed to the end smoothly without any hitch or resistance.

EXAMPLE 2

An emulsion explosive was packaged using a paper PE-laminated on both the sides having a structure shown in the following table to obtain an explosive cartridge of 25 mm in diameter and 100 g in weight.

| Layer | Material | Thickness or Areal weight | Treating method | Angle of slide (degree) |
|---|---|---|---|---|
| Outer surface | High-density PE | 40 $\mu$m | Satin finish | 11 |
| Core layer | Kraft paper | 85 g/m$^2$ | — | — |
| Inner surface | High-density PE | 20 $\mu$m | — | 13 |

The explosive cartridge was subjected to the same loading test as performed in Example 1. The cartridge was able to be pushed to the end of the iron tube smoothly without any hitch or resistance.

EXAMPLE 3

An emulsion explosive was packaged by using a paper PE-laminated on both the sides having a structure shown in the following table to prepare an explosive cartridge of 25 mm in diameter and 100 g in weight.

| Layer | Material | Thickness or Areal weight | Treating method | Angle of slide (degree) |
|---|---|---|---|---|
| Outer surface | Low-density | 20 $\mu$m | Satin finish | 11 |

-continued

| Layer | Material | Thickness or Areal weight | Treating method | Angle of slide (degree) |
|---|---|---|---|---|
| | PE | | | |
| Core layer | Kraft paper | 70 g/m$^2$ | — | — |
| Inner surface | Low-density PE | 20 μm | — | 13 |

The explosive cartridge was subjected to the same loading test as performed in Example 1. The cartridge was able to be pushed to the end of the iron tube smoothly without any hitch or resistance.

COMPARATIVE EXAMPLE

An emulsion explosive was packaged by using a paper PE-laminated on both the sides having a structure shown in the following table to prepare an explosive cartridge of 25 mm in diameter and 100 g in weight.

| Layer | Material | Thickness or Areal weight | Treating method | Angle of slide (degree) |
|---|---|---|---|---|
| Outer surface | High-density PE | 20 μm | — | 13 |
| Core layer | Kraft paper | 70 g/m$^2$ | — | — |
| Inner surface | High-density PE | 20 μm | — | 13 |

The obtained explosive cartridge was subjected to the same loading test as performed in the above Examples. The cartridge could not be pushed smoothly into the iron tube as it occasionally got caught by the wall of iron tube and also met with significant resistance in the loading process.

What is claimed is:

1. An explosive cartridge produced by packaging an explosive with a paper polyethylene-laminated on both the sides, the outer surface of the cartridge having an angle of slide of not more than 12 degrees.

2. The explosive cartridge according to claim 1, wherein both the outer surface and the inner surface of the cartridge have an angle of slide of not more than 12 degrees.

3. The explosive cartridge according to claim 1, wherein said angle of slide is 11 to 8 degrees.

4. The explosive cartridge according to claim 1, wherein the paper is kraft paper.

5. The explosive cartridge according to claim 1, wherein said explosive is a water in oil type emulsion explosive.

6. A paper polyethylene-laminated on both the sides, at least one of the outer surfaces of the paper polyethylene-laminated on both the sides having an angle of slide of not more than 12 degrees.

7. The paper polyethylene-laminated on both the sides according to claim 6, wherein both the outer surfaces thereof have an angle of slide of not more than 12 degrees.

8. The paper polyethylene-laminated on both the sides according to claim 6, wherein said angle of slide is 11 to 8 degrees.

9. The paper polyethylene-laminated on both the sides according to claim 6, wherein said paper is kraft paper.

* * * * *